United States Patent [19]

Larsen et al.

[11] Patent Number: 4,506,614

[45] Date of Patent: Mar. 26, 1985

[54] ANTI-JAM THRUST WASHER FOR SEWING MACHINE LOOPTAKER

[75] Inventors: Robert H. Larsen, Middletown; Charles R. Odermann, Montville, both of N.J.

[73] Assignee: The Singer Company, Stamford, Conn.

[21] Appl. No.: 512,833

[22] Filed: Jul. 11, 1983

[51] Int. Cl.[3] ..... D05B 57/08; D05B 57/36

[52] U.S. Cl. ..... 112/228

[58] Field of Search ..... 112/182, 183, 184, 191, 112/193, 228, 229, 230, 231, 232

[56] References Cited

U.S. PATENT DOCUMENTS

| | | | |
|---|---|---|---|
| 189,931 | 4/1877 | Follett | 112/228 |
| 418,895 | 1/1890 | Leilich | 112/191 |
| 2,015,472 | 9/1935 | Goosman | 112/228 |

*Primary Examiner*—Wm. Carter Reynolds

*Attorney, Agent, or Firm*—William V. Ebs; Robert E. Smith; Edward L. Bell

[57] ABSTRACT

A thrust washer on the looptaker shaft of a sewing machine between the underside of a hook body and the top end of a bushing wherein the looptaker shaft is rotatable is provided with thread engageable peripheral flanges, one of which is disposed to extend upwardly into a recess formed in the hook body and the other one of which extends downwardly over the top edge of the bushing.

3 Claims, 4 Drawing Figures

ANTI-JAM THRUST WASHER FOR SEWING MACHINE LOOPTAKER

DESCRIPTION

1. Field of the Invention

The invention relates to sewing machine looptakers and, more particularly, to devices for rotatably supporting a looptaker in a lockstitch sewing machine.

2. Description of the Prior Art

It has been the common practice to rotatably support a looptaker shaft depending vertically from the hook body of a looptaker in a bushing which is affixed in the bed of a sewing machine and to provide a thrust washer on the shaft between the top end of the bushing and underside of the hook body. However, it has been found with such a construction that a loose thread end, such as might be accidentally released by an operator at the start of a seam or result from thread breakage, will often be carried to the underside of the hook body and either: (1) become jammed between the thrust washer and bushing, or the thrust washer and hook body; or (2) find its way over or under the thrust washer to the looptaker shaft and become wound thereon. The machine must then be shut down, the looptaker removed from the bed, and the thread end retrieved.

It is a prime object of the present invention to prevent loose ends of thread from being jammed between a thrust washer and hook body or bushing in a sewing machine, or from being wrapped onto the looptaker shaft.

It is another object of the invention to provide a thrust washer and an overlying hook body in a sewing machine with thread engageable portions effective to prevent loose ends of thread from moving into a gap between the washer and hook body, or a gap between the washer and an underlying bushing.

Other objects and advantageous of the invention will become apparent during a reading of the specification taken in connection with the accompanying drawings.

SUMMARY OF THE INVENTION

The underside of a hook body in a sewing machine is formed outwardly from a central portion of the body with a depending annular ring. Such depending ring and the central portion of the body define an annular recess wherein an upwardly extending peripheral flange on a washer formed in accordance with the invention is received. The washer also includes a depending peripheral flange which extends downwardly to project beyond the upper end of a bushing that rotatably supports a shaft depending from the hook body. The depending flange extends to a position in close proximity to a surface of the sewing machine bed wherein the bushing is affixed.

DESCRIPTION OF THE PREFERRED EMBODIMENT

Figure 1:
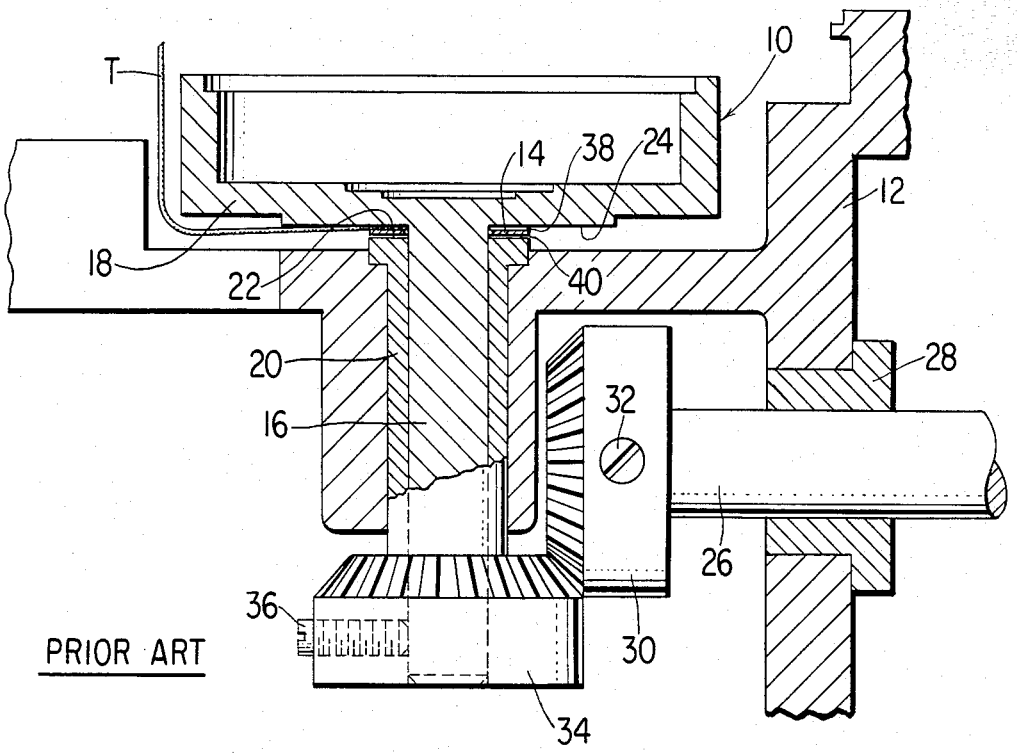
FIG. 1 is a vertical sectional view taken lengthwise in a sewing machine bed through the axis of rotation of a looktaker shaft and showing a mounting arrangement for the looptaker according to the prior art.

Referring to FIG. 1 of the drawings showing a mounting arrangement according to the prior art for a looptaker 10 in a sewing machine bed 12, there may been seen a thrust washer 14 on a shaft 16 depending from the hook body 18 of the looptaker. The looptaker shaft 16 is rotatably mounted in a bushing 20 which is affixed in the bed 12, and the thrust washer 14 is located between the upper end 22 of the bushing and a central portion 24 of the underside of the hook body 18. The looptaker is rotated by a drive shaft 26 extending through a fixed bushing 28 in the bed 12, and acting through meshing bevel gears including a gear 30 affixed onto shaft 26 with set screw 32 and a gear 34 affixed to the lower end of looptaker shaft 16 with set screw 36.

In the prior art arrangment of FIG. 1, a loose end of thread T will tend to be carried to the underside of hook body 18 and to either: (1) become jammed between the thrust washer 14 and bushing 20, or the thrust washer and the central portion 24 of the underside of hook body 18; or (2) find its way, over the thrust washer through a gap 38 or under the thrust washer through a gap 40, to the looptaker shaft and be wound thereon. Such fouling tendency of the thread is aggravated by the accumulation of static charges on the looptaker, bushing, thrust washer and thread, all of which can be at different potentials.

Figure 2:
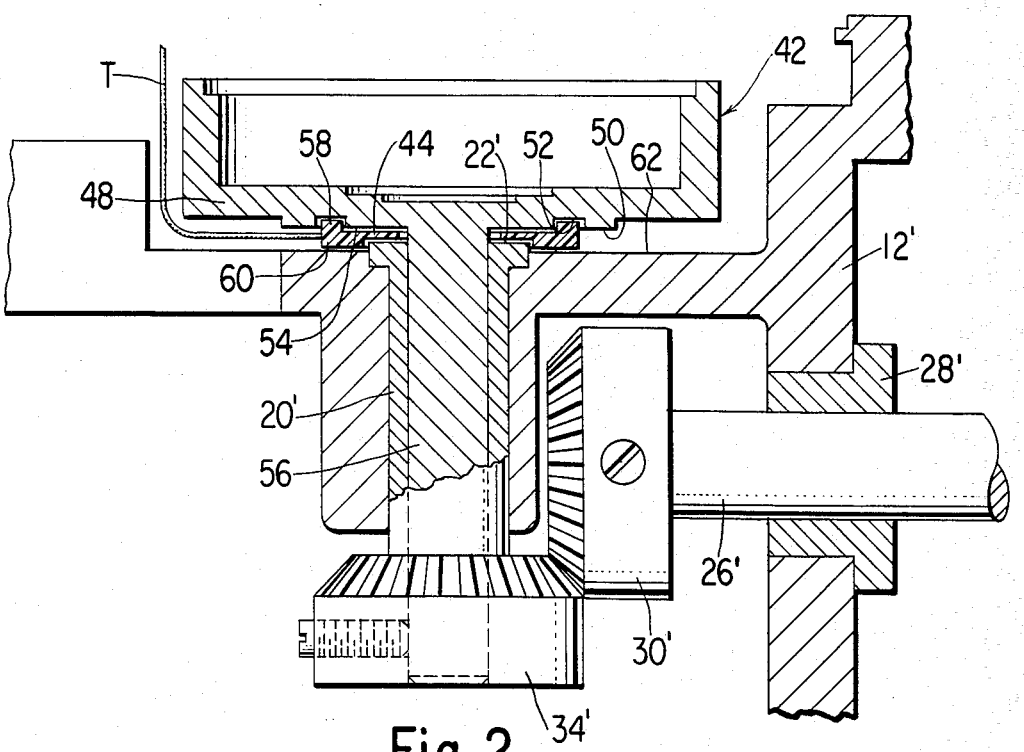
FIG. 2 is a view similar to FIG. 1, showing a looptaker mounting arrangement according to the invention.
Figure 3:
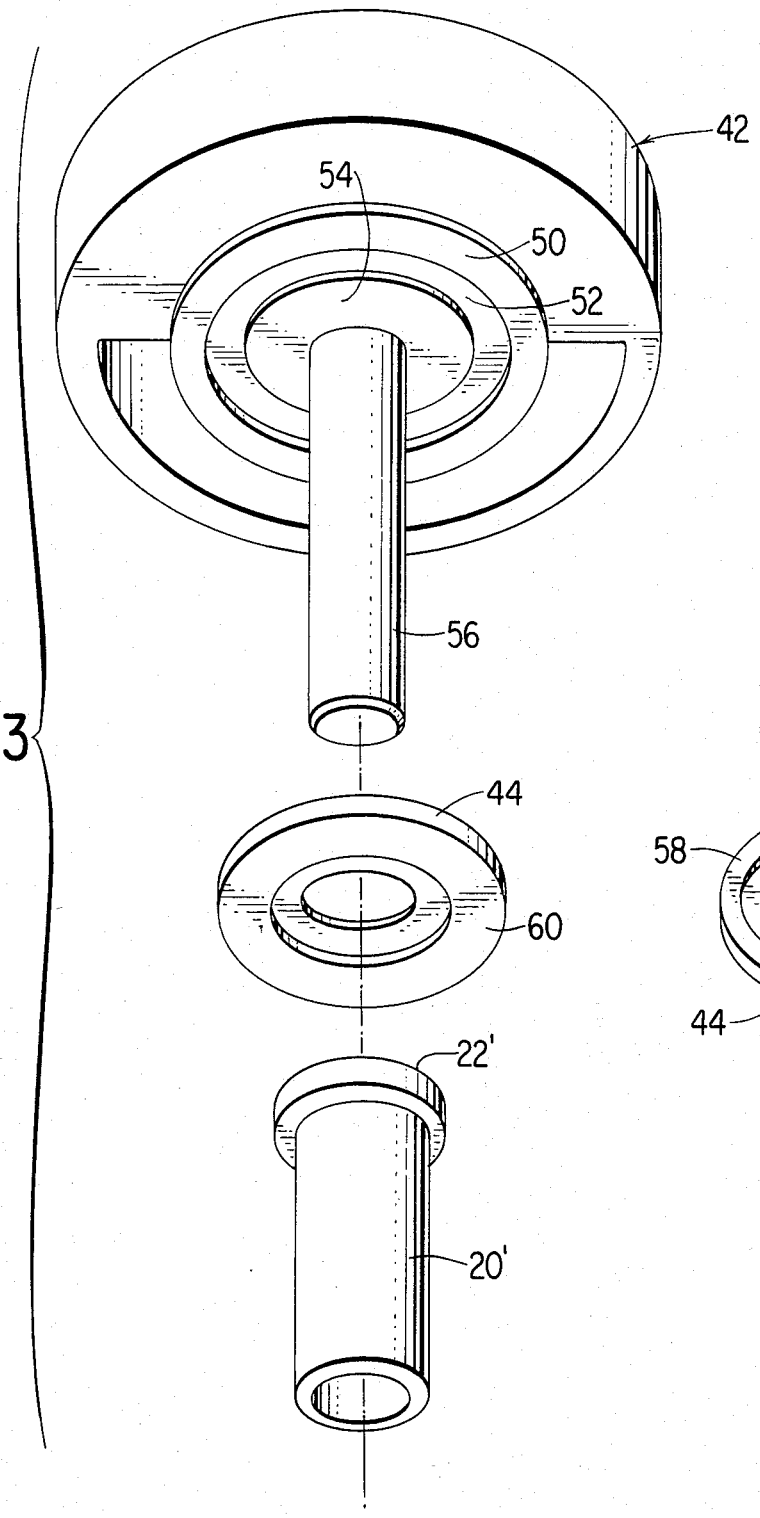
FIG. 3 is an exploded perspective underside view showing elements of the arrangement of the invention.
Figure 4:
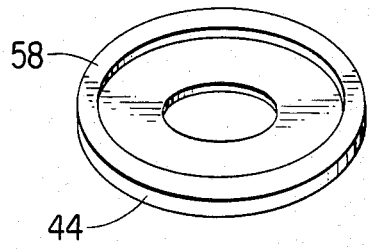
FIG. 4 is a perspective top view of a thrust washer constructed in accordance with the invention.

Referring now to FIGS. 2, 3 and 4, there is shown a construction according to the invention including a number of parts which are identical to parts already shown in FIG. 1, and which have been designated with like reference characters having a prime mark (′) added thereto. Such identical parts include machine bed 12′, drive shaft 26′, bushing 28′, meshing gears 30′ and 34′, and bushing 20′. The construction of the invention further includes a modified looptaker 42 and modified thrust washer 44.

Looptaker 42 is formed according to the invention on the underside of a hook body 48 with a depending ring 50 which forms an annular recess 52 with a central portion 54 of the hook body. Thrust washer 44 located on the looptaker shaft 56 between the underside of the hook body and the upper end 22′ of bushing 20′ projecting beyond horizontal bed surface 62. The washer is formed with an annular upwardly extending peripheral flange 58 and an annular downwardly extending peripheral flange 60. Flange 58 extends into recess 52, and flange 60 projects downwardly beyond the upper end 22′ of bushing 20′ into close proximity with horizontally extending bed surface 62. Thrust washer 44 is preferably a molded plastic part.

In the arrangment of the invention, depending ring 50 on hook body 48 and upwardly extending peripheral flange 58 of washer 44 in recess 52 form a tortious path for a loose end of thread T tending to move over the top of the washer to the looptaker shaft, whereas depending flange 60 and upper end portion of bushing 20′ form a tortious path for a loose end of thread tending to move under the washer to the looptaker shaft. Furthermore, depending ring 50 on the rotating hook body 48 acts to deflect loose thread away from the washer. In addition, because of the extended width of the periphery of the thrust washer with a thread exposed portion thereat between depending ring 50 and bed surface 62 of greater width than the distance between the underside of the hook body and upper end of the bushing, and because of greater tendency for the washer to rotate with the looptaker on account of increased areas engageable with the looptaker at greater radii in the construction of the invention, the washer itself serves to fend off thread tending to move radially inward under the looptaker hook body. In the arrangment of the invention, loose ends of thread are therefor prevented from becoming entangled about the looptaker shaft, or from being jammed between the thrust washer and hook body or bushing.

It is to be understood that the present disclosure relates to a preferred embodiment of the invention which is for purposes of illustration only, and is not to be construed as a limitation of the invention. Numerous alterations and modifications to the structure herein will suggest themselves to those skilled in the art, and all such modifications and alterations which do not depart from the spirit and scope of the invention are intended to be included within the scope of the appended claims.

We claim:

1. In a sewing machine; a looptaker including a hook body with a depending shaft and an annular recess in the underside of the hook body; a bushing which is affixed in the bed of the machine with the axis extending vertically and the upper end projecting beyond a horizontal surface in the bed, the looptaker shaft being rotatably mounted in said bushing; and a rotatable thrust washer on the looptaker shaft between the underside of the hook body and an upper end of the bushing, the thrust washer including an annular flange which extends upwardly into the hook body recess, and an annular flange which extends downwardly beyond the upper end of the bushing, said upwardly and downwardly extending annular flanges extending to the periphery of the thrust washer and presenting a movable exposed peripheral portion of greater width than the distance between said upper end of the bushing and the underside of the hook body to thread extending under the looptaker to the thrust washer.

2. The combination of claim 1 wherein the thrust washer is a molded plastic member.

3. The combination of claim 1 wherein the hook body includes a depending annular ring which is radially outward from the periphery of the thrust washer.

* * * * *